United States Patent [19]

Gryctko et al.

[11] 4,217,472

[45] Aug. 12, 1980

[54] COMPACT CIRCUIT BREAKER HAVING HIGH INTERRUPTING CAPACITY

[75] Inventors: Carl E. Gryctko, Cherry Hill, N.J.; Bernard DiMarco, Bellefontaine; Andrew J. Kralik, Marysville, both of Ohio

[73] Assignee: Gould Inc., Rolling Meadows, Ill.

[21] Appl. No.: 847,789

[22] Filed: Nov. 2, 1977

[51] Int. Cl.[2] ..... H01H 33/08

[52] U.S. Cl. ..... 200/144 R; 200/147 R

[58] Field of Search ..... 200/147 B, 144 R

[56] References Cited

U.S. PATENT DOCUMENTS

| | | | |
|---|---|---|---|
| 2,575,730 | 11/1951 | Sandin et al. | 200/147 B |
| 2,861,152 | 11/1958 | Scully | 200/147 B |

*Primary Examiner*—Robert S. Macon

*Attorney, Agent, or Firm*—Ostrolenk, Faber, Gerb & Soffen

[57] ABSTRACT

A compact molded case circuit breaker having a high interrupting capacity is provided with an arc chute constructed of stacked metal plates notched to form a passage for the movable contact as it moves between open and closed circuit position. The stationary contact is at one end of the arc chute and the arc plate at the other end of the arc chute is provided with a tab that extends outside of the arc chute. In its fully open position, the movable contact is positioned so that at least half of it is outside the arc chute, adjacent the free end of the tab on the last contact plate, and slightly spaced therefrom. The movable contact, in the terminal portion of its movement toward full open circuit position, moves generally parallel to the tab of the last arc plate. This construction assures that all of the arc plates will become active almost instantaneously at the time the movable contact reaches the tab.

4 Claims, 4 Drawing Figures

COMPACT CIRCUIT BREAKER HAVING HIGH INTERRUPTING CAPACITY

This invention relates to compact molded case circuit breakers in general and more particularly relates to circuit breakers of this type constructed for rapid interruption of relatively high short circuit currents, say in excess of 65,000 amperes at 240 volts, in excess of 25,000 amperes at 480 volts, and in excess of 22,000 amperes at 600 volts.

The F. W. Kussy copending application Ser. No. 642,497 filed Dec. 19, 1975 for Stacked Circuit Breakers Having High Interrupting Capacity discloses an extremely compact construction for single pole molded case circuit breakers. As taught by the instant invention, the interrupting capacity of this type of circuit breaker is increased substantially by providing an arc chute constructed of parallel metal plates having notches which cooperate to form a passage through which the movable contact travels. In the full Off position of the movable contact, at least half of it is positioned beyond the planar portion of the last arc plate and adjacent to the free end of a tab which extends from the last arc plate outside of the arc chute. This tab extends generally parallel to the sweep of the contact as the latter approaches the full Off position to insure rapid transfer of the arc to the last arc plate. All of the arc plates will become active very quickly to contribute toward relatively rapid arc interruption.

Accordingly, a primary object of the instant invention is to provide a novel construction for a compact molded case circuit breaker having relatively high interrupting capacity.

Another object is to provide a circuit breaker of this type in which arc extinction is relatively rapid.

Still another object is to provide a circuit breaker of this type in which the movable contact and arc chute are constructed to cooperate in a manner such that all of the arc plates become functional very quickly.

A further object is to provide a circuit breaker of this type having a relatively small arc chute.

These objects as well as other objects of this invention shall become readily apparent after reading the following description of the accompanying drawings in which.

Figure 2:
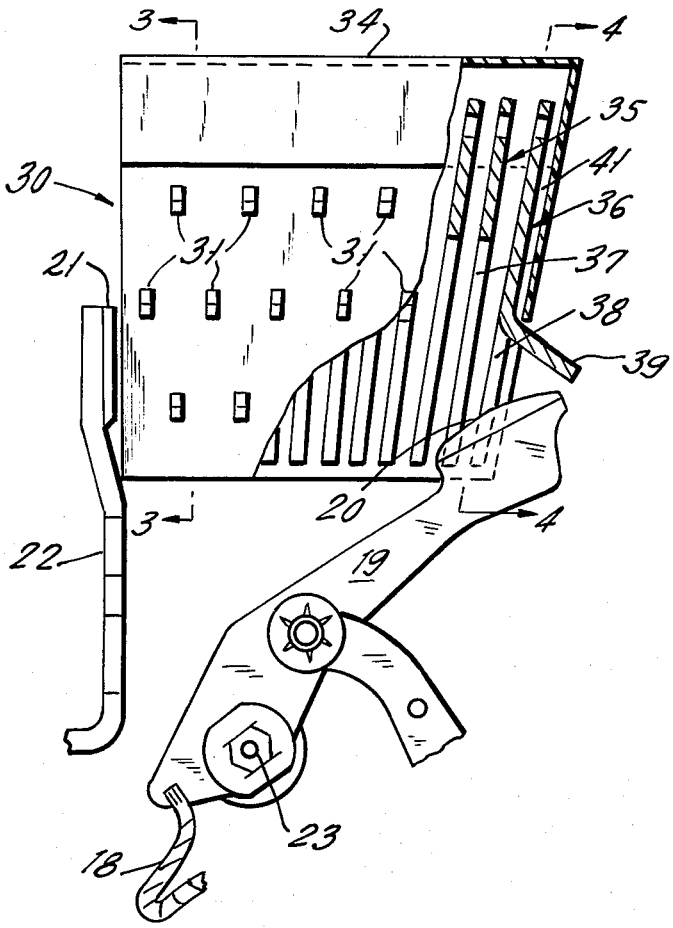
FIG. 2 is a fragmentary portion of FIG. 1 with the movable contact in its full open position.
Figure 3:
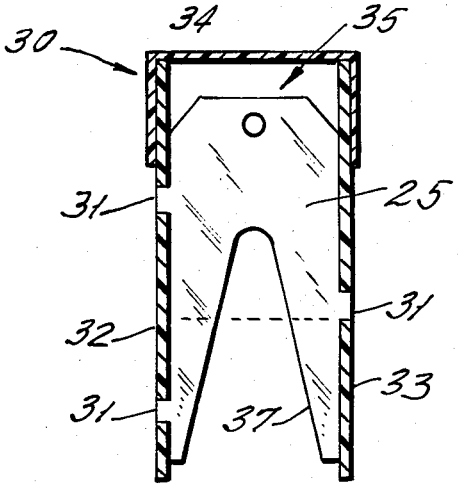
Figure 4:
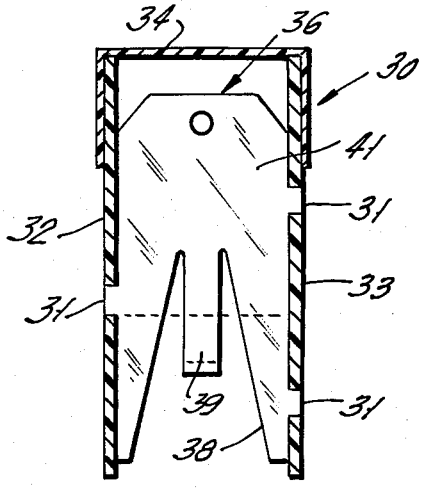

FIGS. 3 and 4 are cross-sections of the arc chute taken through the respective lines 3—3 and 4—4 of FIG. 2 looking in the directions of the respective arrows 3—3 and 4—4.

Figure 1:
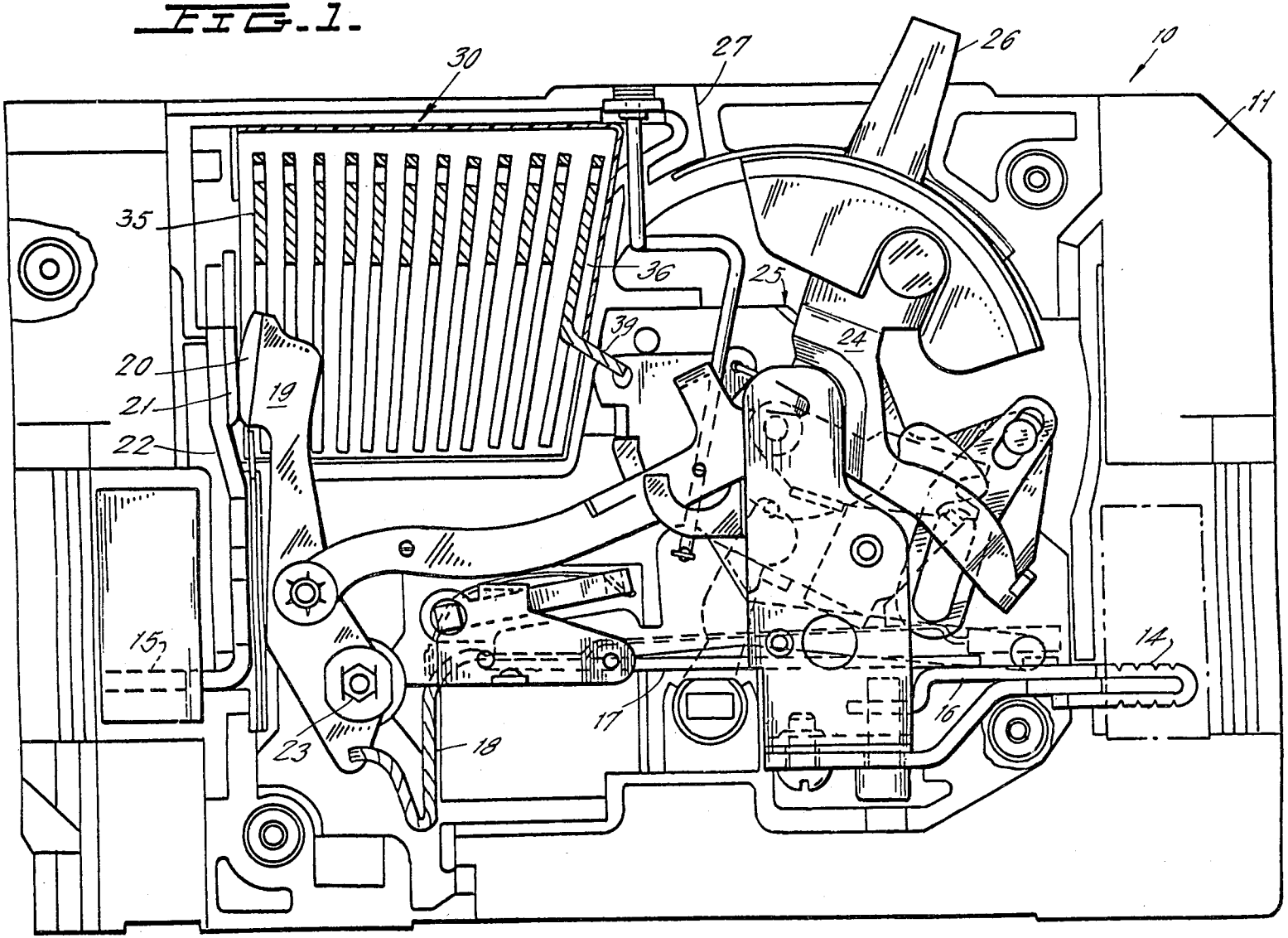
FIG. 1 is a side elevation of a closed circuit breaker constructed in accordance with teachings of the instant invention, with the housing cover removed to reveal the contact operating mechanism and current carrying elements.

Now referring to the Figures. Single pole circuit breaker 10 of FIG. 1 is of the type described in detail in the T. J. Rys and B. DiMarco copending U.S. application Ser. No. 817,357 filed July 7, 1977, entitled Resetting Means For Trip Free Circuit Breaker Contact Operating Mechanism. Briefly, circuit breaker 10 includes a molded insulating housing consisting of molded insulating base 11 and a mating cover (not shown). Disposed within housing 11 are the current carrying elements and contact operating mechanism. The current path between line terminal 14 and load terminal 15, disposed at opposite ends of housing 11, comprises line terminal member 16, directly heated elongated bimetal 17, flexible braid 18, movable contact arm 19, movable contact 20, stationary contact 21 and load terminal member 22. Contact arm 19 is mounted on pivot 23 so as to be movable between circuit open and closed positions by trip free spring powered toggle-type operating mechanism 25. The latter includes operating member 24 provided with manually engageable handle 26 which extends through housing opening 27 beyond the narrow front surface of housing 11.

Movable contact 20, in moving between the closed circuit position of FIG. 1 and the fully open position of FIG. 2, moves through arc chute 30. The latter includes a plurality of metal arc plates held in closely spaced face-to-face relationship by staked side protrusions 31 which are received by positioning apertures in relativly rigid insulating side members 32, 33. Cap 34 constructed of folded insulating sheet material closes the rear of arc chute 30 and extends forward adjacent a portion of main planar section 41 of the last arc plate 36. The latter is disposed at the end of arc chute 30 remote from stationary contact 21 which is disposed against first arc plate 35.

The other ten arc plates of arc chute 30 are of substantially identical construction including a wide mouthed V-notch 37 at the forward edge thereof. Last arc plate 36 is provided with V-notch 38 of a size and shape similar to that of V-notch 37. Stationary contact 21 is positioned in alignment with notches 37, 38 and these notches are aligned with each other to provide a passage through which movable contact 20 travels as it moves from the closed circuit position of FIG. 1 to the full open position of FIG. 2. Last arc plate 36 is provided with narrow tab 39 which extends forward from the apex of notch 38 and is inclined with respect to main planar section 41 of arc plate 36 so as to extend outside of arc chute 30 to the right thereof when viewed in FIG. 1.

As seen in FIG. 2, movable contact 20, in the full open position thereof, is disposed adjacent the free end of tab 39 and closely spaced with respect thereto. In this position slightly more than half of movable contact 20 extends outside of arc chute 30 at the end thereof bounded by the plane in which main section 41 of last arc plate 36 is disposed. Tab 39 is inclined so that it extends basically parallel to the sweep of the rear tip of movable contact 20 as this tip travels opposite tab 39.

The relationship between the travel of movable contact 20 and the construction of arc chute 30 results in rapid transfer of arcs to tab 39 and insures that all of the arc plates of arc chute 30 become functional very quickly resulting in rapid extinction of relatively high current arcs.

Although there has been described a preferred embodiment of this invention, many variations and modifications will now be apparent to those skilled in the art. Therefore, this invention is to be limited, not by the specific disclosure herein, but only by the appended claims.

What is claimed is:

1. A circuit breaker including a relatively stationary contact, a movable contact engaged with said stationary contact when said circuit breaker is closed, operating means for separating said contacts by moving the movable contact to a full open circuit position, an arc chute to receive and facilitate extinction of electric current arcs drawn between said contacts upon separation thereof, said arc chute including a plurality of arc plates disposed in closely spaced face-to-face relationship to form a stack wherein the first of said plates in said stack is disposed at a first end of a said arc chute and the last of said plates in said stack is disposed at a second end of said arc chute, said stationary contact positioned at said first end, said movable contact when in said full open circuit position is at said second end with at least half of said movable contact extending outside of said arc chute beyond a main planar portion of the last of said arc plates, said plates including said last plate having notches in their forward edges cooperating to form a passage for movement of said movable contact from engagement with said stationary contact to said full open circuit position, the last of said arc plates including tab means projecting at an angle from said main planar portion from a point thereof at the rear of the notch in said last arc plate, said tab means extending beyond the second end of said arc chute, said movable contact when in said full open circuit position being disposed in closely spaced relation with the free end of said tab means.

2. A circuit breaker as set forth in claim 1 in which said tab means extends generally parallel to the path of movement of the rear end of said movable contact where said path is opposite said tab means.

3. A circuit breaker as set forth in claim 2 in which the arc plates are constructed of metal having relatively poor current carrying capabilities.

4. A circuit breaker as set forth in claim 3 in which there are thin insulating plates to which the side edges of the arc plates are secured.

* * * * *